US008464392B2

(12) United States Patent
Sato et al.

(10) Patent No.: US 8,464,392 B2
(45) Date of Patent: Jun. 18, 2013

(54) ELECTRIC VACUUM CLEANER

(75) Inventors: Tsuyoshi Sato, Minato-Ku (JP); Masatoshi Tanaka, Minato-Ku (JP); Yoshiyuki Iwata, Minato-Ku (JP)

(73) Assignees: Kabushiki Kaisha Toshiba, Tokyo (JP); Toshiba Consumer Electronics Holdings Corporation, Tokyo (JP); Toshiba Home Appliances Corporation, Tokyo (JP)

( * ) Notice: Subject to any disclaimer, the term of this patent is extended or adjusted under 35 U.S.C. 154(b) by 538 days.

(21) Appl. No.: 12/680,902

(22) PCT Filed: Nov. 25, 2008

(86) PCT No.: PCT/JP2008/071336
§ 371 (c)(1),
(2), (4) Date: Mar. 31, 2010

(87) PCT Pub. No.: WO2009/069591
PCT Pub. Date: Jun. 4, 2009

(65) Prior Publication Data

US 2010/0218341 A1 Sep. 2, 2010

(30) Foreign Application Priority Data

Nov. 28, 2007 (JP) ..... 2007-307938

(51) Int. Cl.
*A47L 9/00* (2006.01)

(52) U.S. Cl.
USPC ..... 15/339; 15/327.1; 15/327.2; 15/352

(58) Field of Classification Search
USPC ..... 15/327.1, 327.2, 339, 352
See application file for complete search history.

(56) References Cited

U.S. PATENT DOCUMENTS

| | | | |
|---|---|---|---|
| 2,500,832 | A | 3/1950 | Kirby |
| 4,411,674 | A | 10/1983 | Forgac |
| 4,443,235 | A | 4/1984 | Brenholt |

(Continued)

FOREIGN PATENT DOCUMENTS

| | | |
|---|---|---|
| EP | 1554965 | 7/2005 |
| JP | 48-10345 | 4/1973 |

(Continued)

OTHER PUBLICATIONS

Search Report of International Application No. PCT/JP2008/071336 mailed Mar. 10, 2009.

(Continued)

*Primary Examiner* — Lee D Wilson
*Assistant Examiner* — Shantese McDonald
(74) *Attorney, Agent, or Firm* — DLA Piper LLP (US)

(57) ABSTRACT

The present invention provides an electric vacuum cleaner which can reliably absorb vibration accompanying driving of an electric blowing part.

An electric blowing part 11 which is driven to generate a negative pressure is housed in a main body case 5. An energizing means 29 which energizes the electric blowing part 11 from the front side toward the center of gravity G of the electric blowing part 11 in a side view, and an energizing means 30 which energizes the electric blowing part 11 from the rear side, are provided on the main body case 5. Vibration accompanying driving of the electric blowing part 11 can be reliably absorbed by energizing of springs of the energizing means 29 and 30, and vibration can be isolated from the main body case 5.

6 Claims, 6 Drawing Sheets

U.S. PATENT DOCUMENTS

| | | | | |
|---|---|---|---|---|
| 5,120,333 | A | 6/1992 | Davis | |
| 7,276,099 | B2 | 10/2007 | Hayashi | |
| 7,346,957 | B2 * | 3/2008 | Nakamoto et al. | 15/352 |
| 7,351,273 | B2 | 4/2008 | Handte | |
| 7,479,171 | B2 | 1/2009 | Cho | |
| 7,655,077 | B2 | 2/2010 | Fielding | |
| 7,736,406 | B2 | 6/2010 | Kuroki | |
| 2007/0125049 | A1 | 6/2007 | Menrik | |
| 2008/0168616 | A1 | 7/2008 | Tanaka et al. | |
| 2008/0235901 | A1 | 10/2008 | Tanaka et al. | |

FOREIGN PATENT DOCUMENTS

| | | | |
|---|---|---|---|
| JP | 46-093909 | | 8/1973 |
| JP | 48-58660 | | 8/1973 |
| JP | 118572/1977 | | 9/1977 |
| JP | 56-032637 | | 8/1981 |
| JP | 02-159233 | | 6/1990 |
| JP | 5-084194 | * | 4/1993 |
| JP | 05-084194 | | 4/1993 |
| JP | 11-253371 | | 9/1999 |
| JP | 2000-354567 | | 12/2000 |
| JP | 2001-204655 | | 7/2001 |
| JP | 2002-085299 | | 3/2002 |
| JP | 2004-194806 | | 7/2004 |
| JP | 2004-358135 | | 12/2004 |
| JP | 2005-131135 | | 5/2005 |
| JP | 2005-211285 | | 8/2005 |
| JP | 2006-006453 | | 1/2006 |
| JP | 3864660 | | 10/2006 |

OTHER PUBLICATIONS

English language abstract of JP-05-084194.
English language abstract of JP-2001-204655.
Machine English language translation of JP Patent No. 3864660.
Machine English language translation of JP-05-084194.
Machine English language translation of JP-2001-204655.
English language abstract of JP 2005-211285, published Aug. 11, 2005.
Machine English language translation of JP 2005-211285, published Aug. 11, 2005.
Machine English language translation of JP 2004-194806, published Jul. 15, 2004.
English language abstract of JP 02-159233, published Jun. 19, 1990.
English language translation of Office Action issued in Japanese Application No. 2007-004431, mailed Oct. 15, 2008.
International Search Report of PCT/JP2007/056581 mailed May 29, 2007.
English language translation of JP-2006-006453 published Jan. 12, 2006.
English language translation of JP-2005-131135—published May 26, 2005.
English language translation of JP-2004-358135 published Dec. 24, 2004.
International Preliminary Report on Patentability issued on Oct. 21, 2008 in PCT/US07/056581.
English language Abstract of JP-2006-006453 English language translation of JP-2006-006453 published Jan. 12, 2006.
English language Abstract of JP-2005-131135—published May 26, 2005.
English language Abstract of JP-2004-358135 published Dec. 24, 2004.
English language Abstract of JP-2004-194806 published Jul. 15, 2004.
European Search Report dated Sep. 3, 2009 issued in EP 08 25 0030.
U.S. Appl. No. 12/042,581.
U.S. Appl. No. 12/294,432.
English Language Translation of JP 48-010345 published Apr. 1973.
English Language Translation of JP 48-058660 published Aug. 1973.
English Language Translation of JP 52-118572 Published Sep. 8, 1977.
English Language Translation of JP 2001-204655 published Jul. 31, 20101.
English Language Abstract of JP 2001-204655 published Jul. 31, 20101.
Office Action issued in Chinese Application No. 200880112118.6, mailed Nov. 2, 2012.
English Language Translation of Office Action issued in Chinese Application No. 200880112118.6, mailed Nov. 2, 2012.
English Language Abstract of JP 2002-085299 published Mar. 26, 2002.
English Language Translation of JP 2002-085299 published Mar. 26, 2002.
English Language Abstract of JP 11-253371 published Sep. 21, 1999.
English Language Translation of JP 11-253371 published Sep. 21, 1999.
English Language Abstract of JP 2000-354567 published Dec. 26, 2000.
English Language Translation of JP 2000-354567 published Dec. 26, 2000.
International Search Report issued in PCT/JP2010/065224 dated Oct. 5, 2010.
Related U.S. Appl. No. 13/637,705.
U.S. Appl. No. 11/970,846.

* cited by examiner (a)

(b)

ELECTRIC VACUUM CLEANER

TECHNICAL FIELD

The present invention relates to an electric vacuum cleaner in which an electric blowing part is elastically supported on a main body case.

BACKGROUND ART

Some electric vacuum cleaners include a vacuum cleaner main body in which an electric blowing part is housed inside a main body case. A dust collecting chamber to which a negative pressure is applied by driving of an electric blowing part is provided in the main body, and this duct collecting chamber is communicatively connected to a hose body, an extension tube, and a floor brush via a main body suction port opened in the main body case. The electric blowing part includes a substantially cylindrical electric blower and a motor cover as a substantially cylindrical holding member which covers and holds the electric blower. The electric blower is elastically supported inside the motor cover by a biasing member or members such as a plurality of springs disposed radially or the like. The motor cover holding the electric blower is supported on the main body case by an elastic member such as rubber (refer to, for example, Japanese Patent No. 3864660 (page 4, FIGS. 2 and 3)

DISCLOSURE OF THE INVENTION

Problem to be Solved by the Invention

When the electric blower is driven, vibration in the circumferential (radial) direction of the electric blower is generated by rotation of a motor inside the electric blower, and vibration in the axial direction is also generated by driving of the electric blower and suctioning of the electric blowing part toward the dust collecting chamber side by a negative pressure generated by the driving.

However, in the above-described electric vacuum cleaner, although the vibration in the circumferential (radial) direction of the electric blower is absorbed by the biasing members inside the motor cover and the elastic member supporting the motor cover on the main body case, the vibration in the axial direction cannot be sufficiently absorbed.

A support member such as a motor support rubber for elastically supporting the electric blowing part on the main body case can be attached to both end portions in the axial direction of the electric blowing part. However, even with this arrangement, the vibration in the axial direction of the electric blowing part is transmitted to the main body case via the support member and is not sufficiently absorbed.

The present invention has been made in consideration of the above-described problem, and an object thereof is to provide an electric vacuum cleaner which can reliably absorb vibration accompanying driving of the electric blowing part.

Means to Solve the Problems

The present invention includes an electric blowing part which is housed in a main body case and is driven to generate a negative pressure, and biasing members which are provided on the main body case and apply force to the electric blowing part toward the side of the center of gravity from sides opposite to each other in a side view.

Effect of the Invention

According to the present invention, by applying force to the electric blowing part toward the side of the center of gravity from sides opposite to each other by the biasing members, vibration accompanying driving of the electric blowing part can be reliably absorbed by applying force with the biasing members.

Figure 1:
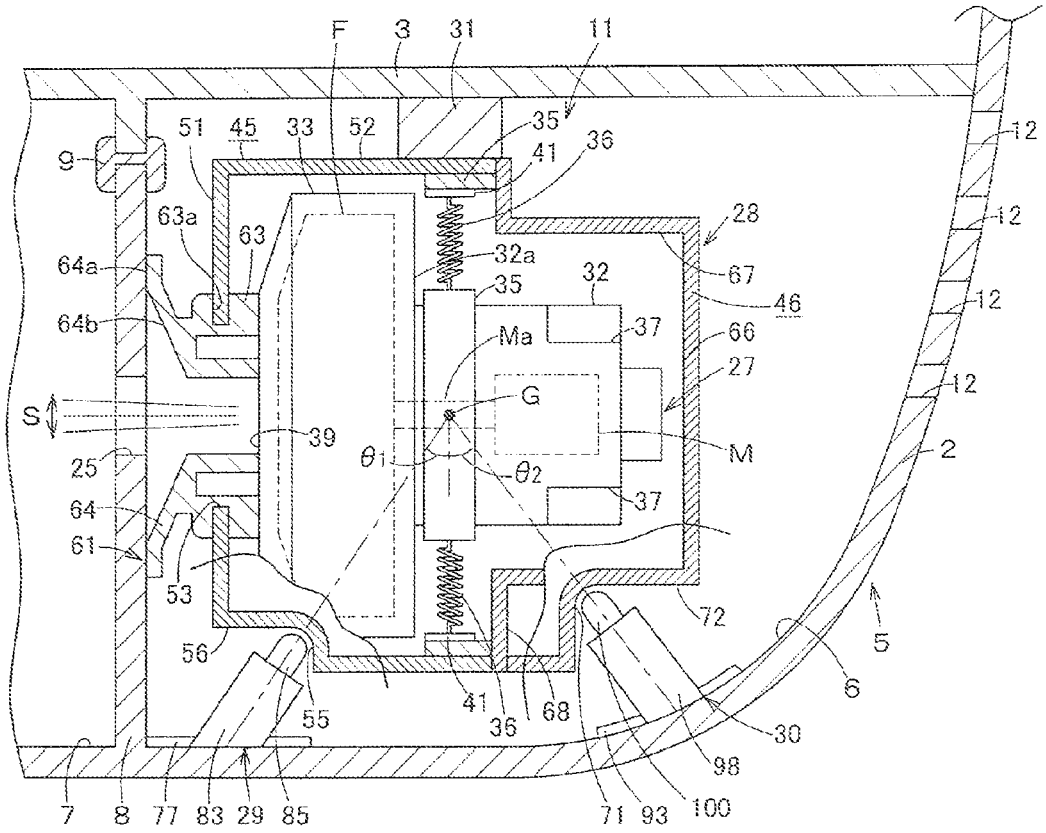
FIG. 1 is a longitudinal sectional view showing an electric vacuum cleaner of a first embodiment of the present invention.

| REFERENCE NUMERALS | |
|---|---|
| 5 | Main body case |
| 7 | Dust collecting chamber |
| 11 | Electric blowing part |
| 27 | Electric blower |
| 28 | Motor cover as holding member |
| 29, 30 | Biasing member |
| 36 | Coil spring as blowing part biasing member |
| 55, 71 | Supported portion |
| 61 | Seal ring as sealing member |
| 84, 99 | Spring as biasing member main body |
| 85, 100 | Piston as support |
| 105 | Elastic wheel as rotary member |
| F | Centrifugal fan as fan |
| M | Electric motor |

BEST MODE FOR CARRYING OUT THE INVENTION

Hereinafter, a configuration of an electric vacuum cleaner of a first embodiment of the present invention will be described with reference to FIGS. 1 to 5.

Figure 5:
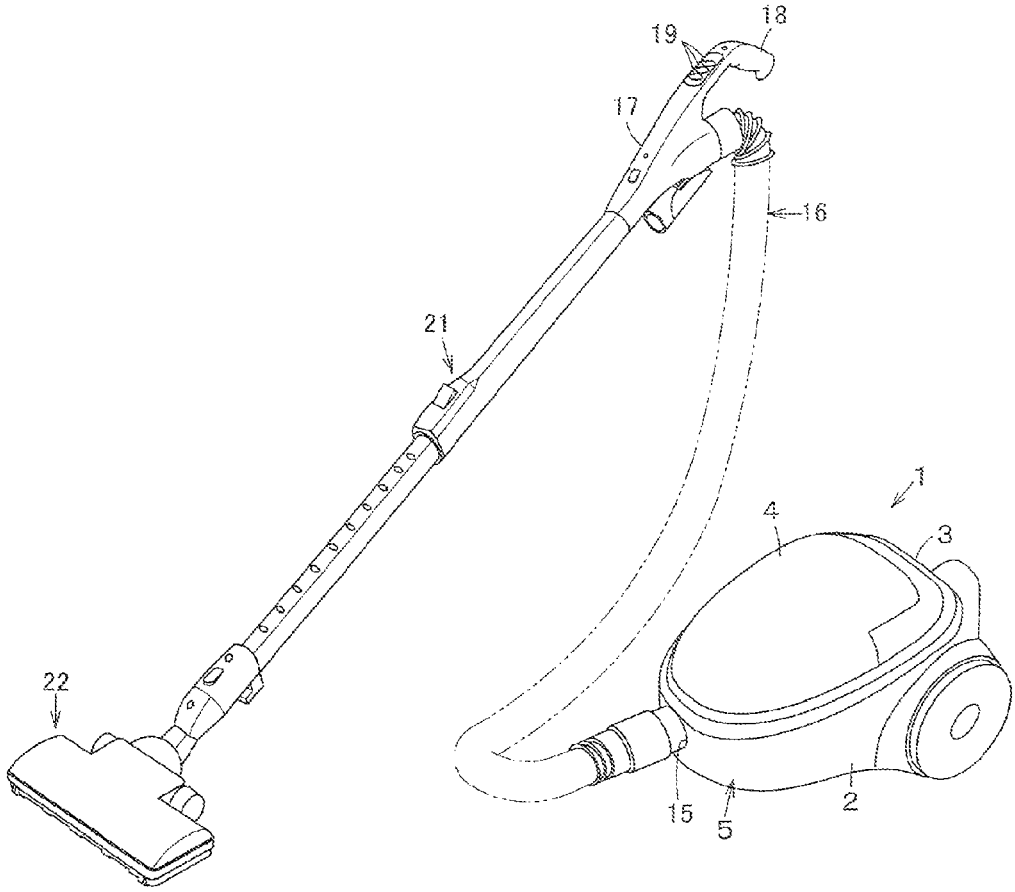
FIG. 5 is a perspective view showing the same electric vacuum cleaner.

In FIG. 5, the reference numeral 1 denotes a vacuum cleaner main body, and this vacuum cleaner main body 1 is a canister type electric vacuum cleaner capable of cleaning a floor surface.

This vacuum cleaner main body 1 includes a main body case 5 including: a lower case 2 opened upward; an upper case 3 covering the upper rear side of the lower case 2, and a lid body 4 capable of opening and closing the upper front side of the lower case 2. In the main body case 5, a blowing chamber 6 is provided between the lower case 2 and upper case 3, a dust collecting chamber 7 is provided between the lower case 2 and lid body 4, and a partitioning wall 8 is provided between the blowing chamber 6 and dust collecting chamber 7 to separate the blowing chamber 6 and dust collecting chamber 7.

As shown in FIG. 1, the blowing chamber 6 is a space formed by connecting airtightly the lower case 2 and the upper case 3 via a seal packing 9 and partitioned by the partitioning wall 8. The blowing chamber 6 houses a substantially cylindrical electric blowing part 11 so that the axial direction of the electric blowing part 11 is along the front-rear direction. This blowing chamber 6 communicates with the outside of the main body case 5 via exhaust holes 12 opened in the rear portion of the lower case 2. Further, a cord reel chamber for housing a cord reel (not shown), around which a power cord (not shown) capable of supplying power from the outside to the electric blowing part 11 is wound, is provided at the side of the blowing chamber 6.

A paper pack (not shown) dust collecting bag serves as a dust collector. The power pack is removably fitted in the dust collecting chamber 7. At the front portion of this dust collecting chamber 7, a main body suction port 15 is opened in the lower case 2. In this main body suction port 15, a hose body 16 is removably provided, and a hand operation part 17 is attached to a tip end portion of this hose body 16. On this hand operation part 17, a grip part 18 to be gripped by an operator is protruded. A plurality of setting buttons 19 to be used by an operator for setting an operation mode of the electric blowing part 11 are provided on the grip part 18. An extension tube 21 and a floor brush 22 as a suction port body are successively communicatively connected to the tip end portion of the hand operation part 17.

A circular large-diameter communication hole 25 which provides communication between the blowing chamber 6 and the dust collecting chamber 7 is formed in the partitioning wall 8. The electric blowing part 11 is connected airtightly to the rear portion of this communication hole 25. A filter (not shown) is disposed on the dust collecting chamber 7 side on the front portion of the communication hole 25.

The electric blowing part 11 includes, as shown in FIGS. 1 to 4, a fan motor, i.e., electric blower 27 as a heavy object, and a substantially cylindrical motor cover 28 as a comparatively lightweight holding member which covers the electric blower 27 like a capsule and holds it. Force is applied to the electric blower 27 from the lower side by biasing members 29 and 30 and supported from the upper side by a elastic support member 31 as an elastic member.

The electric blower 27 includes a bottomed cylindrical motor frame 32 as a case body, and a substantially cylindrical fan cover 33 which is fitted to the front side on the opening side of the motor frame 32, and is held inside a motor cover 28 so that the axial direction corresponds to that of the motor cover 28. To the periphery of this electric blower 27, an inner peripheral side spring support 34 and an outer peripheral side spring support 35, which are spring receiving rings as biasing members support members, are attached. Between these spring supports 34 and 35, a plurality of coil springs 36 as blowing part biasing members are held, and the electric blower 27 is elastically supported on the motor cover 28 side.

A turnover part 320 is formed on the front end portion of the motor frame 32. The turnover part 32*a* is folded back radially like a flange so as to expand its diameter. A bridge (not shown) is fixed along the radial direction to the turnover part 32*a*. Inside the motor frame 32, an electric motor M is housed between the motor frame 32 and the bridge. A diffuser (not shown) which is a rectifier as a stator blade, is attached to the front portion of the bridge. To the lower end portion of a rotary shaft Ma of the electric motor M inserted in the central portion of the bridge, a centrifugal fan F which is a rotor blade (i.e., a fan to be covered by a fan cover 33) is connected.

In the peripheral surface nearer the rear side of the motor frame 32, a plurality of quadrangular exhaust ports 37 are opened spaced at substantially even intervals in the circumferential direction. Attachment holes (not shown) are provided at positions between these exhaust ports 37, and brush mechanisms (not shown) to be electrically connected to the commutator of the electric motor M are attached to the attachment holes.

In the central portion of the fan cover 33, an air suction port 39 communicating with the downstream side of a duct 26 is opened.

The electric blower 27 suctions air from the air suction port 39 by the centrifugal fan F rotated by the electric motor M and exhausts the suctioned air to the outside of the motor frame 32 via the exhaust ports 37 from the inside of the motor frame 32 while rectifying the suctioned air by the diffuser, etc., to apply a negative pressure to the duct 26, the dust collecting chamber 7, the hose body 16 (FIG. 5), the extension tube 21 (FIG. 5), and the floor brush 22 (FIG. 5), etc.

The inner peripheral side spring support 34 is made into a ring shape from, for example, synthetic resin or metal, etc., and is closely fitted to the periphery of the motor frame 32 to hold the electric blower 27. This inner peripheral side spring support 34 is attached to the motor frame 32 so that the axial direction corresponds to that of the electric blower 27, and the central region in the front-rear direction (axial direction) is located at a position corresponding to the center of gravity G in a side view of the electric blower 27 (the center of gravity of the electric blowing part 11) nearer the front end of the motor frame 32 at the rear of the turnover part 32*a*. In other words, the central axis of the inner peripheral side spring support 34 passes through the center of gravity G. On the outer peripheral side of the inner peripheral side spring support 34, a plurality of spring holding parts 41 as elastic holding parts holding one end portions of coil springs 36 are formed at, for example, three positions.

Each of these spring holding parts 41 includes a holding cylindrical portion 41*a* to which one end of a coil spring 36 is fitted on the inner peripheral side and a protruding holding portion 41*b* which protrudes radially inside the holding cylindrical portion 41*a* and is inserted in the coil spring 36 to hold the coil spring 36. The spring holding parts 41 are spaced by substantially equal angles (120 degrees in the present embodiment) from each other in the circumferential direction of the inner peripheral side spring support 34.

The outer peripheral side spring support 35 is made from, for example, synthetic resin or metal, etc., into a ring shape with a diameter larger than that of the inner peripheral side spring support 34, and is disposed concentrically with the inner peripheral side spring support 34 and positioned on the motor cover 28 side. Therefore, the central region in the front-rear direction (axial direction) of this outer peripheral side spring support 35 is also at a position corresponding to the center of gravity G, and the central axis passes through the center of gravity G. On the inner peripheral side of the outer peripheral side spring support 35, corresponding to spring holding parts 41 of the inner peripheral side spring support 34, spring holding parts 43 as elastic holding parts for holding the other end portions of the coil springs 36 are formed.

Each of the spring holding parts 43 includes a holding cylindrical portion 43*a* to which one end of each coil spring 36 is fitted on the inner peripheral side, and a protruding holding portion 43*b* which protrudes radially inside the holding cylindrical portion 43*a* and is inserted in the coil spring 36 to hold the coil spring 36.

Therefore, the coil springs 36 are attached radially to the electric blower 27 between the spring supports 34 and 35, and spaced from each other by substantially equal angles. That is, end portions on the electric blower 27 side of the coil springs 36 are held toward the center of gravity G of the electric blower 27 by the spring holding parts 41 of the inner peripheral side spring support 34, and the other end portions are held by the spring holding parts 43 of the outer peripheral side spring support 35. These coil springs 36 are for attenuating the rotational vibration of the electric blower 27.

With respect to the mass $m_1$ of the electric blower 27, considering the balance of the coil springs 36, when Fa is the load of the upper coil spring 36*a* and Fb is the load of both lower coil springs 36*b* and 36*b*, $Fa+m_1=2\cdot Fb\cdot\cos 60^\circ=Fb$ is satisfied. Therefore, considering the spring constant k [N/mm] of the coil springs 36, by adjusting the load lengths thereof, use of springs of the same type for the coil spring 36*a* and the coil springs 36*b* and 36*b* is preferable. In detail, when k=5 [N/mm] and $Fa=m_1=10$ [N], Fb=20 [N], and by setting the coil springs 36*b* 2 mm shorter than the coil spring 36*a*, use of springs of the same type becomes possible.

The motor cover 28 includes a front motor cover 45 as a substantially cylindrical first motor cover, and a rear motor cover 46 as a substantially cylindrical second motor cover to be connected to the rear of the front motor cover 45. The motor cover 28 is formed so as to be assembled and disassembled in the axial direction (thrust direction) of the electric blowing part 11. The motor cover 28 houses the electric blower 27 inside concentrically.

The front motor cover 45 is made from, for example, synthetic resin, etc., and includes a substantially disk-shaped front plate 51 which serves as a front lid and a front peripheral wall 52 extending rearward from the outer peripheral edge portion of the front plate 51. At the substantially central portion of the front plate 51, a circular-hole-shaped front portion communication opening 53 which is a communication opening for making communication between the communication hole 25 of the main body case 5 and the air suction port 39 of the electric blower 27 is opened. Therefore, the front motor cover 45 is opened at the rear end.

On the lower portion of the front peripheral wall 52, for example, a pair of supported portions 55 (only one is shown) to be supported by biasing member 29 are formed. The supported portions 55 are portions to which biasing member 29 are fitted from below, and are formed into arced shapes, (in the present embodiment, spherical recessed shapes in a sectional view along a substantially vertical plane along the axial direction of the electric blowing part 11), open downward, and also open forward due to front continuous portions 56 continuing forward horizontally to the front plate 51.

A substantially cylindrical seal ring 61 which is a packing as a sealing member for airtightly connecting the communication hole 25 communicating with the dust collecting chamber 7 of the main body case 5 and the air suction port 39 of the electric blower 27 on the negative pressure side of the electric blowing part 11 is attached to the front portion communication opening 53. This seal ring 61 is made from a material with elasticity such as, for example, rubber or elastomer, and includes a seal ring main body 63 which is a substantially cylindrical sealing member main body the axial direction of which is along the front-rear direction, and a lip portion 64 which is a substantially cylindrical contact portion formed so as to expand its diameter forward from the front end portion in the axial direction of the seal ring main body 63.

The seal ring main body 63 has a groove portion 63*a* which is formed on the outer peripheral side and fits the inner peripheral edge portion of the front portion communication opening 53 so that the front motor cover 45 is slidable circumferentially. The seal ring main body 63 is attached to the front motor cover 45 by fitting the inner peripheral edge portion of the front portion communication opening 53 to the groove portion 63*a*, and is not fixed circumferentially to the front motor cover 45.

The lip portion 64 is formed to be thinner than the seal ring main body 63. An outer peripheral edge portion which comes into contact with the rear surface on the blowing chamber 6 side of the partitioning wall 8 is formed into a flat contact surface 64*a*, and a rectifying surface 64*b* which is continued to the contact surface 64*a* and slopes so as to reduce its diameter from the front side (upstream side) to the rear side (downstream side) is formed. This lip portion 64 is a vibration attenuating portion which elastically deforms in the axial direction according to vibration in the axial direction of the electric blowing part 11 to attenuate the vibration so as not to transmit the vibration to the main body case 5 via the partitioning wall 8.

The seal ring 64 is attached so as to be slightly biased forward, that is, attached so that the lip portion 64 is brought into slight pressure contact with the rear surface of the partitioning wall 8 in a state where the electric blowing part 11 is stopped.

The rear motor cover 46 is made from, for example, synthetic resin, etc., and includes a substantially disk-shaped rear plate 66 which serves as a rear lid, a rear peripheral wall 67 extending forward from the outer peripheral edge portion of the rear plate 66, and a flange portion 68 extending radially from the outer peripheral edge portion of the rear peripheral wall 67. The flange portion 68 is connected to the rear end of the front peripheral wall 52 of the front motor cover 45 by, for example, screwing. In the rear motor cover 46, rear portion communication openings (not shown) which are communication openings for making communication between the exhaust ports 37 of the electric blower 27 and the exhaust holes 12 of the main body case 5 are opened.

On the lower portion of the rear peripheral wall 67, for example, a pair of supported portions 71 (only one is shown) to be supported by biasing members 30 are formed. The supported portions 71 are portions to which the biasing members 30 are fitted from below, and are fowled into arced shapes, (in the present embodiment, spherical recessed shapes in a sectional view along a substantially vertical plane along the axial direction of the electric blowing part 11), and open downward and also open rearward due to rear continuous portions 72 continued forward horizontally to the rear plate 66.

In the flange portion 68, a plurality of screw holes for screwing are formed (although these are not shown), and by screwing screws (not shown) into these screw holes, the front motor cover 45 and the rear motor cover 46 are fixed to each other.

Figure 3:
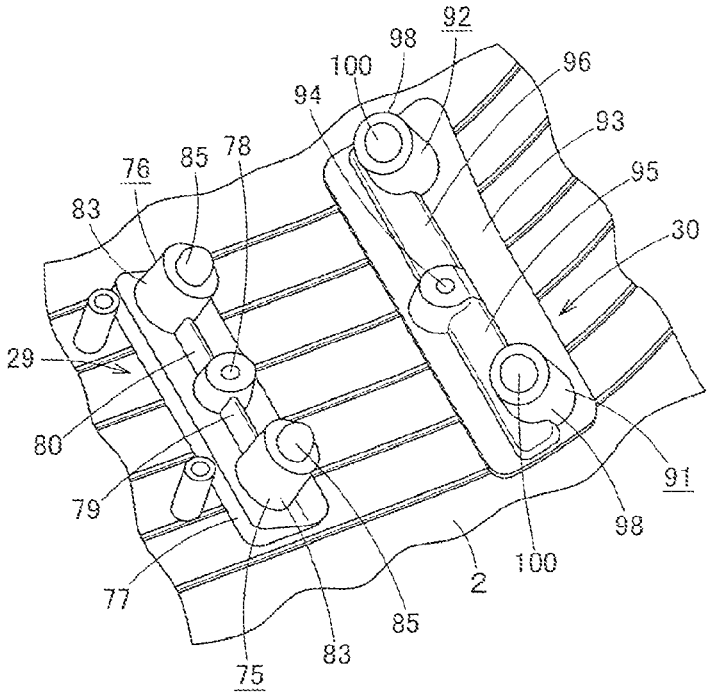
FIG. 3 is a perspective view showing a portion of the same electric vacuum cleaner.
Figure 4:
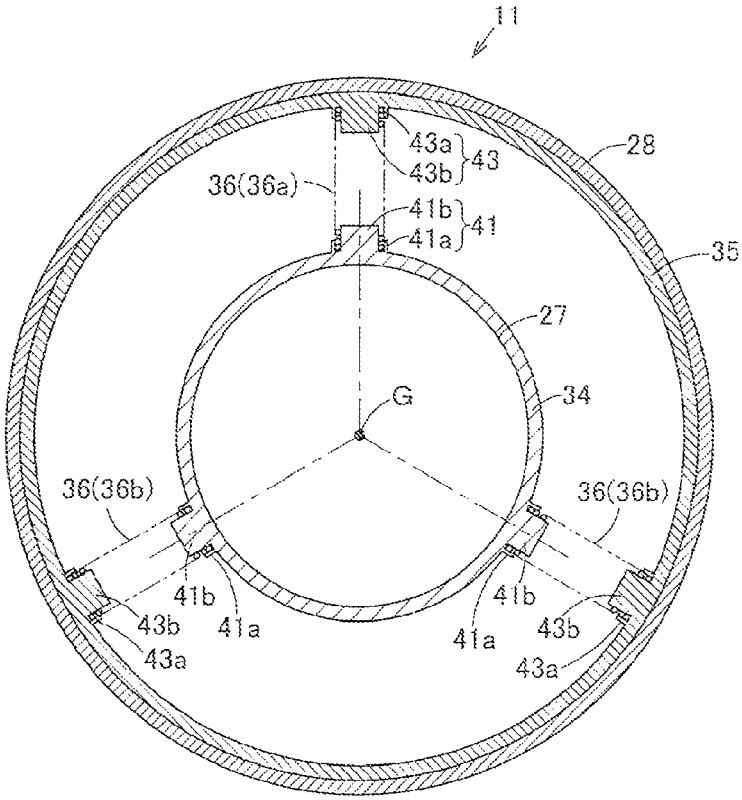
FIG. 4 is a cross sectional view showing a portion of the same electric vacuum cleaner.

The biasing member 29 biases the electric blowing part 11 toward the center of gravity G from the front side in the axial direction as a suction side with respect to the center of gravity G in a side view, that is, from the centrifugal fan F side. As shown in FIG. 3, damper parts 75 and 76 are provided as a pair of force applying parts protruding on an attaching plate part 77 long in the width direction so as to be spaced from each other, and at a substantially intermediate position between the damper parts 75 and 76 of the attaching plate part 77, a boss 78 protrudes for attaching the biasing member 29 to the lower case 2, and between the boss 78 and the damper parts 75 and 76, reinforcing ribs 79 and 80 are formed.

Figure 2:
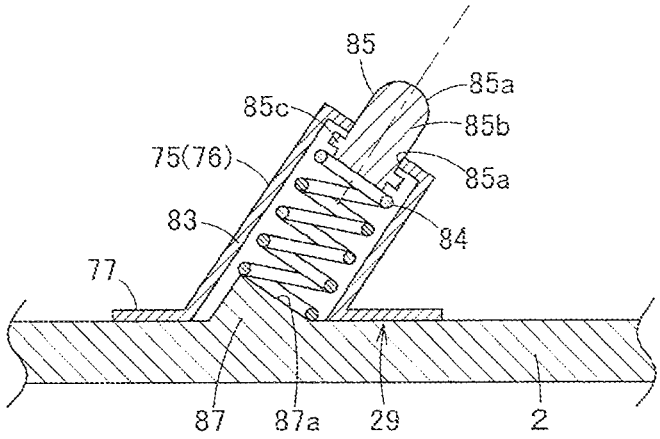
FIG. 2(*a*) is a longitudinal sectional view showing a biasing member positioned on the front side in the axial direction of an electric blowing part of the same electric vacuum cleaner, and FIG. 2(*b*) is a longitudinal sectional view showing a biasing member positioned on the rear side in the axial direction of the same electric blowing part.
Figure 2:
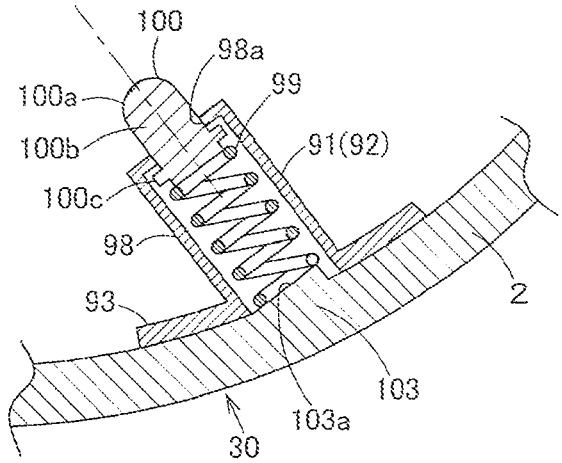

The damper parts 75 and 76 have, as shown in FIGS. 2(*a*) and 3, cylindrical parts 83 as biasing member housing parts, and inside the cylindrical parts 83, springs 84 as biasing member main bodies are housed, and to the upper ends as tip ends of the springs 84, pistons 85 as supports which fit the supported portions 55 are attached. The center position between these damper parts 75 and 76 is positioned on a substantially vertical plane passing through the center of gravity G of the electric blowing part 11. In other words, the damper parts 75 and 76 are separated at both sides substantially equally from the center of gravity G of the electric blowing part 11.

The cylindrical parts 83 protrude so as to incline with respect to the attaching plate part 77 while their center axes are directed toward the center of gravity G of the electric blowing part 11 in a side view. Specifically, the tip end side of each cylindrical part 83 inclines toward the rear upper side, and in the tip end, an opening 83*a* for exposing the tip end side of the piston 85 is opened. To the lower end portion of the cylindrical part 83, an attaching portion 87 for positioning (preventing displacement of) the attaching plate part 77, protruding from the upper surface of the lower case 2, is fitted. The attaching portion 87 is formed into a flat inclined support surface 87*a* the upper end side of which is along a direction substantially orthogonal to the central axis of the cylindrical part 83. That is, the inclined support surface 87*a* is formed so as to incline with respect to the lower case 2.

The spring 84 is a damper member having directivity in the direction of force, and the direction of force is inclined in a side view along the axial direction of the cylindrical part 83, that is, toward the center of gravity G of the electric blowing part 11. The lower end side of the spring 84 is supported by the inclined support surface 87*a*, and the basal end side of the piston 85 is joined to the upper end side. The expansion and contraction direction of the spring 84 is further guided by the cylindrical part 83. In other words, the cylindrical part 83 serves as a guide for expansion and contraction of the spring 84. This spring 84 has a length set so as to become capable of biasing the piston 85 toward the tip end side inside the cylindrical part 83 and to prevent the entire piston 85 from entering the inside of the cylindrical part 83 when the spring 84 contracts maximally.

The piston 85 includes a piston main body 85*b* having a support surface 85*a* formed on the tip end, and a stopper portion 85*c* protruding radially from the piston main body 85*b*. The piston 85 is slidable along the axial direction of the cylindrical part 83.

The support surface 85*a* is a portion which comes into contact with the supported portion 55, and is formed into an arced shape (in the present embodiment, a spherical shape in a side view along a substantially vertical plane along the axial direction of the electric blowing part 11). Therefore, the piston 85 supports the electric blowing part 11 by the spherical surface.

The tip end side of the piston main body 85*b* is exposed from the opening 83*a* of the cylindrical part 83, and the basal end side is positioned inside the cylindrical part 83.

The stopper portion 85*c* is for preventing the entire piston 85 from popping out from the cylindrical part 83 due to force applied by the spring 84, and is formed so as to protrude radially more than the inner diameter of the opening 83*a* of the cylindrical part 83.

In the boss 78, a screw, etc., (not shown) is inserted and screwed to the lower case 2 side.

The biasing member 30 applies force to the electric blowing part 11 toward the center of gravity G from the rear side in the axial direction with respect to the center of gravity G in a side view, that is, from the electric motor M side opposite to the biasing member 29 to absorb vibration in the axial direction of the electric blowing part 11, and has the same configuration as that of the biasing member 29. The biasing member 30 includes damper parts 91 and 92 as a pair of force applying parts which protrude on an attaching plate part 93 long in the width direction while being spaced from each other, and at a substantially intermediate position between the damper parts 91 and 92 of the attaching plate part 93, a boss 94 protrudes for attaching the biasing member 30 to the lower case 2, and between the boss 94 and the damper parts 91 and 92, reinforcing ribs 95 and 96 are formed.

The damper parts 91 and 92 have cylindrical parts 98 as biasing member housing parts as shown in FIGS. 2(*b*) and 3. Inside the cylindrical parts 98, springs 99 as biasing member main bodies are housed, and to the upper ends as tip ends of the springs 99, pistons 100 as supports which fit the supported portions 71 are attached. The center position between these damper parts 91 and 92 is positioned on a substantially vertical plane passing through the center of gravity G of the electric blowing part 11. In other words, the damper parts 91 and 92 are separated at both sides substantially equally from the center of gravity G of the electric blowing part 11. The distance between the damper parts 91 and 92 is longer than, for example, the distance between the damper parts 75 and 76 of the biasing member 29.

The cylindrical parts 98 protrude so as to incline with respect to the attaching plate part 93 while their center axes are directed toward the center of gravity G of the electric blowing part 11 in a side view. Specifically, the tip end side of each cylindrical part 98 inclines toward the front upper side, and in the tip end, an opening 98*a* for exposing the tip end side of the piston 100 is opened. To the lower end portion of the cylindrical part 98, an attaching portion 103 which protrudes from the upper surface of the lower case 2 and is for positioning (preventing displacement of) the attaching plate part 93, is fitted. The attaching portion 103 is formed into a flat inclined support surface 103*a* the upper end side of which is along a direction substantially orthogonal to the central axis of the cylindrical part 98. That is, the inclined support surface 103*a* is formed so as to incline with respect to the lower case 2.

The spring 99 is a damper member having directivity in the direction of force, and the direction of force is inclined along the axial direction of the cylindrical part 98, that is, toward the center of gravity G of the electric blowing part 11 in a side view. The lower end side of the spring 99 is supported by the inclined support surface 103*a*, and to the upper end side, the basal end side of the piston 100 is joined. The expansion and contraction direction of the spring 99 is further guided by the cylindrical part 98. In other words, the cylindrical part 98 serves as a guide for expansion and contraction of the spring 99. This spring 99 has a length set so as to become capable of biasing the piston 100 toward the tip end side inside the cylindrical part 98 and to prevent the entire piston 100 from entering the inside of the cylindrical part 98 when the spring 99 contracts maximally.

The piston 100 includes a piston main body 100*b* having a support surface 100*a* formed on the tip end, and a stopper portion 100*c* protruding radially from the piston main body 100*b*. The piston 100 is slidable along the axial direction of the cylindrical part 98.

The support surface 100*a* is a portion which comes into contact with the supported portion 71, and is formed into an arced shape, in the present embodiment, a spherical shape in a sectional view along a substantially vertical plane along the axial direction of the electric blowing part 11. Therefore, the piston 100 supports the electric blowing part 11 by the spherical surface.

The tip end side of the piston main body 100*b* is exposed from the opening 98*a* of the cylindrical part 98, and the basal end side is positioned inside the cylindrical part 98.

The stopper portion 100*c* is for preventing the entire piston 100 from popping out from the cylindrical part 98 due to force applied by the spring 99, and is formed so as to protrude radially more than the inner diameter of the opening 98*a* of the cylindrical part 98.

In the boss 94, a screw, etc., (not shown) is inserted and screwed to the lower case 2 side.

The biasing members 29 and 30 are configured so that the positions of intersections between the planes whose planar directions are in the directions of force of the springs 84 and 99 and the vertical plane passing through the intermediate position between the damper parts 75 and 76 (damper parts 91 and 92) come to the center of gravity G of the electric blowing part 11, and holds the electric blowing part 11 at the center position at which the applied forces are well-balanced, that is, has a centering operation in the axial direction (front-rear direction) of the electric blowing part 11.

Considering the balance of the springs 84 and 99, when, respectively, Fc and Fd are loads of the springs 84 and 99, $\theta_1$ and $\theta_2$ are the inclination angles of the springs 84 and 99 with respect to the vertical direction, and $m_2$ ($>m_1$) is the mass of the electric blowing part 11, $m_2=2\cdot(Fc\cdot\cos\theta_1+Fd\cdot\cos\theta_2)$ is satisfied. The loads and the inclination angles of the springs 84 and 99 are set according to this equation.

The elastic support member 31 attenuates vibration in the up-down direction of the electric blowing part 11, and is made from a material with elasticity such as, for example, rubber or elastomer, and positioned between the outer peripheral surface of the front peripheral wall 52 of the front motor cover 45 of the motor cover 28 and the upper case 3.

Next, operations of the first embodiment described above will be described.

When cleaning, first, the hose body 16, the extension tube 21, and the floor brush 22 are successively communicatively connected to the main body suction port 15, and the lid body 4 of the main body case 5 is opened and a paper pack is loaded in the dust collecting chamber 7, and the lid body 4 is closed.

In this state before starting cleaning, the electric blowing part 11 is located at a predetermined start position in the axial direction (front-rear direction) by the balance of the applied forces of the biasing members 29 and 30.

When an operator pulls out the power cord from the main body case 5, connects the cord to an outlet of a wall or the like, grips the grip part 18 and operates a predetermined setting button 19, the electric blower 27 of the electric blowing part 11 is driven.

Due to driving of the electric blower 27 and a negative pressure generated by this driving, the electric blowing part 11 vibrates almost entirely in the front-rear direction of the axial direction.

At this time, the pistons 85 and 100 fit the supported portions 55 and 71 of the electric blowing part 11, and accordingly, forces are applied in directions to push the pistons 85 and 100 into the cylindrical parts 83 and 98 against the force applied by the springs 84 and 99 of the biasing members 29 and 30, however, the electric blowing part 11 is biased forward or rearward so as to be well-balanced by the biasing members 29 and 30 by force applied by the springs 84 and 99, that is, the electric blowing part 11 is centered by the biasing members 29 and 30, and the vibration in the axial direction accompanying driving of the electric blowing part 11 is absorbed.

At the same time, on the seal ring 61, the contact surface 64*a* of the lip portion 64 is brought into pressure contact with the blowing chamber 6 side of the partitioning wall 8 to airtightly connect the communication hole 25 and the air suction port 39 of the electric blower 27. At this time, vibration, etc., caused when starting the electric blowing part 11 are absorbed by the elasticity of the lip portion 64, and are hardly transmitted to the partitioning wall 8.

Due to driving of the electric blower 27, inside the electric blowing part 11, vibration occurs almost entirely in the radial direction (central axis direction) crossing the rotation direction of the electric blower 27.

At this time, coil springs 36 applying force toward the center of gravity G of the electric blower 27 each properly expand and contract to center the electric blower 27, and accordingly, vibration in the radial direction (central axis direction) accompanying driving of the electric blower 27 is also absorbed.

Then, according to a negative pressure caused by driving of the electric blower 27, an air path which acts on the floor brush 22, the extension tube 21, the hose body 16, the main body suction port 15, and the paper pack is formed, and dust is suctioned together with air.

The suctioned air becomes suctioning wind, and dust contained in this suctioning wind is caught by the paper pack when the air passes through the paper pack. The dust accommodated in the paper pack is compressed by the suctioning wind passing through it.

Further, the suctioning wind which has passed through the paper pack passes through the filter and the communication hole 25, and flows into the inside of the fan cover 33 of the electric blower 27 via the air suction port 39 of the electric blowing part 11 while being rectified by the rectifying surface 64*b* of the seal ring 61, and suctioned from the central portion of the centrifugal fan F and exhausted in the circumferential direction, and passes through the inside of the motor frame 32 while being rectified by the diffuser so that the direction of the wind is turned toward a predetermined direction, and is exhausted to the outside of the electric blower 27 as exhaust wind from the exhaust ports 37.

These exhaust winds are exhausted to the outside of the main body case 5 from the exhaust holes 12 of the main body case 5 via the rear portion communication opening of the motor cover 28.

When cleaning is finished, the operator operates the setting button 19 to stop the electric blowing part 11 and stop the driving of the electric vacuum cleaner.

At this time, the electric blowing part 11 returns to a predetermined start position by the centering operation of the springs 84 and 99 of the biasing members 29 and 30.

When dust not less than a predetermined amount is accumulated in the paper pack, the operator opens the lid body 4 and takes the paper pack out of the dust collecting chamber 7 and disposes of it together with dust, and loads a new paper pack in the dust collecting chamber 7.

As described above, according to the first embodiment, by applying force to the electric blowing part 11 by the biasing members 29 and 30 toward the center of gravity G from sides opposite to each other with respect to the center of gravity G of the electric blowing part 11 in a side view, vibration accompanying driving of the electric blowing part 11, specifically, vibration in the axial direction when starting the electric blower 27 and vibration in the suctioning-in direction due to a negative pressure caused by driving of the electric blowing part 11 can be more reliably absorbed by biasing of the biasing members 29 and 30, and vibration can be isolated from the main body case 5.

The biasing members 29 and 30 have damper parts 75 and 76 and damper parts 91 and 92 in the width direction, respectively, and accordingly, vibration in the width direction accompanying driving of the electric blowing part 11 can also be absorbed by the biasing members 29 and 30.

Further, the supported portions 55 and 71 having arced sectional shapes are formed on the motor cover 28 of the electric blowing part 11, and the tip end sides of the pistons 85 and 100 of the biasing members 29 and 30 are formed to have arced sectional shapes and fitted to the supported portions 55 and 71, and accordingly, not only vibration along the axial direction of the electric blowing part 11 but also, for example, diagonally downward vibration of the electric blowing part 11 can be reliably absorbed by the biasing members 29 and 30 as long as the vibration includes a component in the axial direction of the electric blowing part 11, and therefore, vibration in the axial direction can be reliably absorbed.

The biasing members 29 and 30 can easily be realized by attaching the pistons 85 and 100 to the tip ends of the springs 84 and 99 and housing these in the cylindrical parts 83 and 98.

Further, when fitting the electric blowing part 11 into the blowing chamber 6 of the main body case 5, it suffices that the electric blowing part 11 is only placed from above the biasing members 29 and 30 so that the pistons 85 and 100 of the biasing members 29 and 30 fit the supported portions 55 and 71, so that the assemblability is also high.

In the electric blowing part 11, inside the motor cover 28, the electric blower 27 is held radially by the plurality of coil springs 36 toward the center of gravity G, so that rotational vibration when driving the electric blower 27 is absorbed by the expansion and contraction of the coil springs 36 and can be made harder to transmit to the motor cover 28.

In addition, these coil springs 36 are at positions corresponding to the center of gravity G of the electric blower 27 in a side view, and therefore, for example, as compared with the case where a position nearer the front end or a position nearer the rear end of the electric blower 27 is supported, the vibration width S (FIG. 1) occurring in the up-down direction at the front or rear of the center of gravity G when driving the electric blower 27 can be minimized, and the vibration can be made harder to transmit to the main body case 5.

By airtightly connecting the dust collecting chamber 7 and the air suction port 39 of the electric blower 27 by connecting the seal ring 61 to the front motor cover 45 of the motor cover 28 slidably in the circumferential direction, even in the state where the electric blowing part 11 vibrates, transmission of the vibration to the main body case 5 via the partitioning wall 8 can be prevented while airtightness between the communication hole 25 and the air suction port 39 of the electric blower 27 is secured.

By the configuration to prevent transmission of vibration to the main body case 5 as described above, noise caused by vibration of the electric blowing part 11 when driving the electric vacuum cleaner can be prevented, and particularly, even when cleaning a wood floor which easily echoes the vibration, the operation noise is reduced.

Further, an electric blower 27 which causes comparatively great vibration can also be adopted, and the quality becomes stable.

Figure 6:
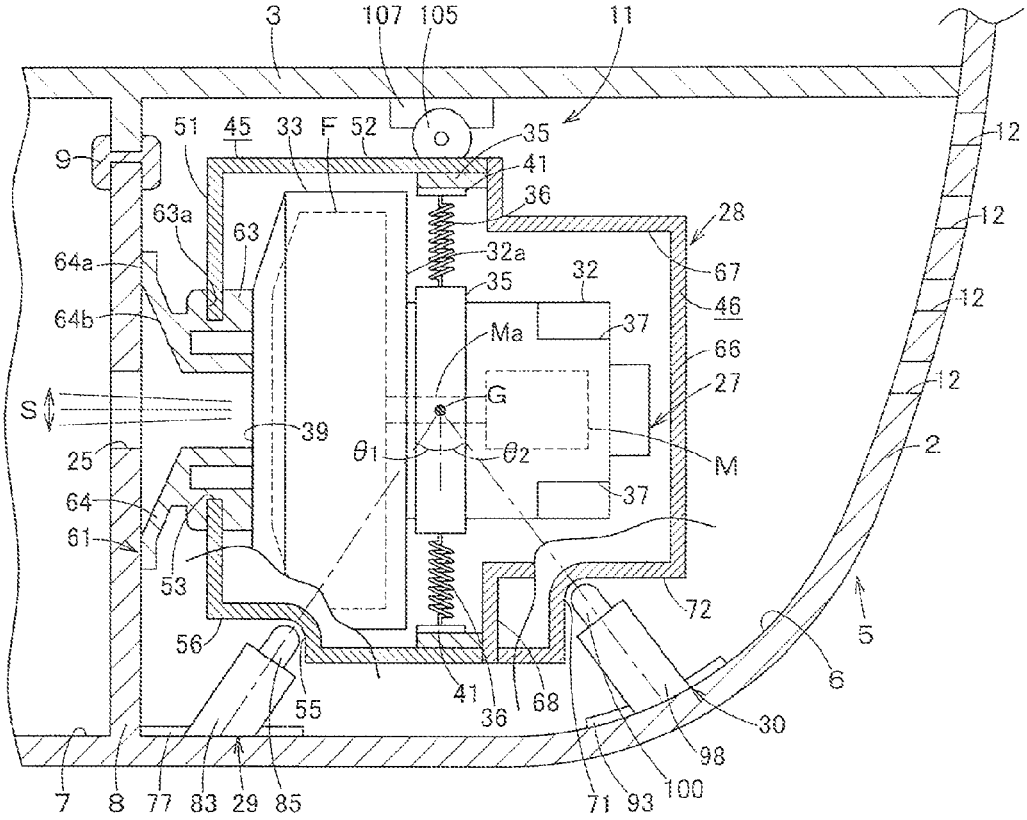
FIG. 6 is a longitudinal sectional view showing a portion of an electric vacuum cleaner of a second embodiment of the present invention.
Figure 7:
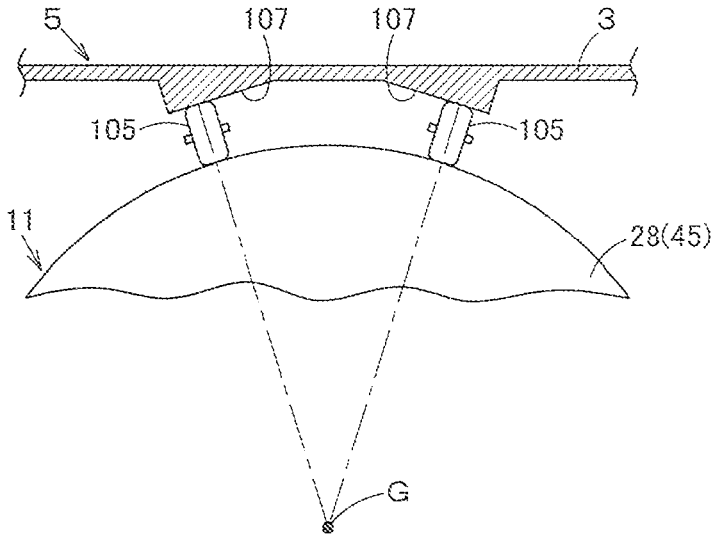
FIG. 7 is a cross sectional view showing a part of the same electric vacuum cleaner.

Next, a second embodiment will be described with reference to FIGS. 6 and 7. Moreover, the same reference numerals and letters are attached to each part having the same configuration and operation as those in the first embodiment described above, and descriptions thereof will be omitted.

In this second embodiment, elastic wheels 105 and 105 as rotary members are attached instead of the elastic support member 31 of the first embodiment.

The elastic wheels 105 are for absorbing vibration in the axial direction of the electric blowing part 11, and are made from an elastic material such as, for example, rubber or elastomer, and have axial directions set along the width direction of the main body case 5, and are axially supported rotatably in the front-rear direction. The elastic wheels 105 are disposed at positions lateral to the apex of the outer peripheral surface on the upper side of the front motor cover 45 above the center of gravity G of the electric blowing part 11 in a side view. Therefore, the elastic wheels 105 are attached radially to the motor cover 28, and their axial directions are along a substantially tangential direction of the outer peripheral surface of the front motor cover 45. The elastic wheels 105 are disposed so as to incline toward the center of gravity G of the electric blowing part 11.

The elastic wheels 105 are in contact with running surfaces 107 formed on the upper case 3 of the main body case 5. These running surfaces 107 are formed to incline laterally and downward so that the elastic wheels 105 come into contact with the running surfaces 107 substantially perpendicularly.

When a load is applied in the axial direction to the electric blowing part 11 due to driving of the electric blower 27 of the electric blowing part 11 and a negative pressure, etc., caused by this driving, according to the centering operation by the biasing members 29 and 30, vibration in the axial direction of the electric blowing part 11 is absorbed, and the vibration is hardly transmitted to the main body case 5, and therefore, the same operation and effect as of the first embodiment described above can be obtained.

By elastically supporting the lower portion of the electric blowing part 11 by the biasing members 29 and 30 and supporting the upper portion of the electric blowing part 11 by the elastic wheels 105 as rotary members which are made from an elastic material and are rotatable in the front-rear direction corresponding to the axial direction of the electric blowing part 11, vibration in the radial direction of the electric blowing part 11 can be absorbed by the elasticity of the elastic wheels 105, and vibration in the axial direction can be more reliably absorbed by the rotations of the elastic wheels 105, and accordingly, the electric vacuum cleaner can be made more silent.

In the embodiments described above, the electric blowing part 11 is not limited to one consisting of the electric blower 27 and the motor cover 28, and may be the electric blower 27 itself, for example. That is, the embodiments also include a configuration in which the electric blower 27 itself is elastically supported by the biasing members 29 and 30.

The holding member is not limited to the motor cover, and may be, for example, a cylindrical holding member or the like.

Further, the electric blowing part 11 is formed by the electric blower 27 and the motor cover 28 by matching their axial directions, however, a configuration in which the axial direction of the electric blower 27 is not matched with the axial direction of the motor cover 28, or a configuration in which the electric blower 27 is held on a holding member such as a case body having no axial direction instead of the motor cover 28, are also possible. Even in this case, by biasing the electric blowing part 11 toward the center of gravity from the sides opposite to each other with respect to the center of gravity G of the electric blowing part 11 in a side view by the biasing members 29 and 30, the same operation and effect as those of each embodiment described above can be obtained. When the electric blower 27 is held on a holding member whose suctioning-in side is set on the front side in the state in which the axial direction of the electric blower 27 is set along the up-down direction, by biasing the electric blowing part 11 by the biasing members toward the center of gravity from the sides opposite to each other in the front-rear direction with respect to the center of gravity of the electric blowing part 11, vibration caused in the front-rear direction of the electric blowing part 11 due to a negative pressure accompanying driving of the electric blowing part 11 can be more reliably absorbed by the biasing members.

For example, the seal ring 61 may be attached to the partitioning wall 8 side instead of the motor cover 28 side. Even when the inner peripheral edge portion of the communication hole 25 is fitted to the groove portion 63*a*, and the lip portion 64 is brought into contact with the peripheral edge portion of the front portion communication opening 53 of the front plate 51 of the front motor cover 45, the same operation and effect can be obtained.

The detailed portions of the electric vacuum cleaner are not limited to the above-described configurations.

INDUSTRIAL APPLICABILITY

The present invention can be preferably used as, for example, a domestic electric vacuum cleaner.

The invention claimed is:

1. An electric vacuum cleaner comprising:

a main body case;

an electric blowing part housed in the main body case and configured to be driven to generate a negative pressure, the electric blowing part disposed in the main body so that a longitudinal axis of the electric blowing part is oriented in a front-to-rear direction of the main body; and a pair of biasing structures provided on the main body case and positioned lower than a center of gravity of the electric blowing part, the pair of biasing structures being configured to apply a force to the electric blowing part diagonally upward toward the center of gravity of the electric blowing pair from a front side of the center of gravity and a rear side of the center of gravity.

2. The electric vacuum cleaner according to claim 1, wherein the electric blowing part includes:

a fan positioned on the front side of the center of gravity; and an electric motor configured to rotate the fan, the electric motor being positioned on the rear side of the center of gravity and the biasing structures are configured to apply the force to the electric blowing part toward the side of the center of gravity from a fan side and an electric motor side.

3. The electric vacuum cleaner according to claim 1 or 2, wherein the electric blowing part includes supporting portions having arced sectional shapes, and each of the biasing structures includes:

a biasing structure main body configured to provide the force; and a support disposed on a tip end of the biasing structure main body, the support having an arced sectional shape and configured to fit in one of the supporting portions.

4. The electric vacuum cleaner according to claim 1 or 2, further comprising:

a rotary member made from an elastic material and contacting the electric blowing part at a position higher than the center of gravity of the electric blowing part to support the electric blowing part.

5. The electric vacuum cleaner according to claim 1 or 2, wherein the electric blowing part includes:

an electric blower;

a holding member which holds the electric blower; and a blowing part biasing structure for elastically supporting the electric blower radially toward the center of gravity inside the holding member.

6. The electric vacuum cleaner according to claim 1 or 2, further comprising:

a dust collecting chamber disposed in the main body case; and a sealing member having a cylindrical shape, and connected to either a main body case or the electric blowing part slidably in the circumferential direction to airtightly connect a negative pressure side of the electric blowing part to a dust collecting chamber.

* * * * *